US007932711B2

(12) United States Patent
Ishizuka et al.

(10) Patent No.: US 7,932,711 B2
(45) Date of Patent: Apr. 26, 2011

(54) POP NOISE SUPPRESSION TECHNIQUE

(75) Inventors: Soichiro Ishizuka, Kanagawa (JP); Toru Ido, Osaka (JP); Naoki Furuya, Kanagawa (JP); Takeshi Anzai, Kanagawa (JP)

(73) Assignee: Texas Instruments Incorporated, Dallas, TX (US)

( * ) Notice: Subject to any disclaimer, the term of this patent is extended or adjusted under 35 U.S.C. 154(b) by 559 days.

(21) Appl. No.: 11/963,089

(22) Filed: Dec. 21, 2007

(65) Prior Publication Data

US 2008/0174362 A1 Jul. 24, 2008

(30) Foreign Application Priority Data

Dec. 22, 2006 (JP) ..... 2006-346635

(51) Int. Cl.
*G05F 3/16* (2006.01)

(52) U.S. Cl. ..... 323/313

(58) Field of Classification Search ..... 323/313, 323/318, 349–351; 330/51; 327/538
See application file for complete search history.

(56) References Cited

U.S. PATENT DOCUMENTS

| | | | | |
|---|---|---|---|---|
| 4,684,925 | A * | 8/1987 | Maruta | 341/166 |
| 5,859,605 | A * | 1/1999 | Raghavan et al. | 341/143 |
| 5,939,938 | A * | 8/1999 | Kalb et al. | 330/51 |
| 6,563,376 | B2 * | 5/2003 | Fujisawa | 330/10 |
| 6,862,432 | B1 * | 3/2005 | Kim | 455/80 |
| 7,142,048 | B2 | 11/2006 | Miyagaki et al. | |
| 7,166,993 | B2 * | 1/2007 | Shimizu et al. | 323/282 |
| 2005/0232372 | A1 * | 10/2005 | Chan | 375/295 |
| 2006/0013413 | A1 | 1/2006 | Sakaidani | |
| 2008/0174362 | A1 | 7/2008 | Ishizuka et al. | |

FOREIGN PATENT DOCUMENTS

| | | |
|---|---|---|
| JP | 2003-110441 | 11/2003 |
| JP | 2006-109275 | 4/2006 |

* cited by examiner

*Primary Examiner* — Adolf Berhane
*Assistant Examiner* — Emily Pham
(74) *Attorney, Agent, or Firm* — John J. Patti; Wade J. Brady, III; Frederick J. Telecky, Jr.

(57) ABSTRACT

A voltage supply circuit and a circuit device can reduce the noise in the output of the circuit when the power to the circuit is turned on and off and can shorten the time required to start or stop the operation of the circuit. When the supply of power to signal processing part 10 is started or stopped, reference voltage Vref supplied to signal processing part 10 is varied continuously to reduce the high-frequency noise in the output of signal processing part 10. Also, when the setpoint value of the waveform of reference voltage Vref is generated by digital signal processing in voltage setting part 30, the desired waveform can be generated without being limited by the values of the circuit elements or the circuit configuration. The output noise of signal processing part 10 can be reduced, and the time that reference time Vref varies can be shortened.

2 Claims, 5 Drawing Sheets

POP NOISE SUPPRESSION TECHNIQUE

TECHNICAL FIELD

The present invention pertains to a voltage supply circuit that supplies a reference voltage to a circuit and to a circuit device equipped with the voltages supply circuit. In circuiticular, the present invention pertains to a voltage supply circuit that can reduce the noise output from the voltage supplied to the circuit when the power is turned on or off.

In general, a constant voltage (reference voltage) is needed as a reference when performing amplification or addition/subtraction, etc. of the input signal of an analog signal processing circuit. If the reference voltage varies, the signal obtained as the result of the processing varies, and error or noise occurs in the final output signal. Consequently, the reference voltage supplied to an analog signal processing circuit is required to remain constant without being affected by the variations in power supply voltage or temperature, noise, etc.

Japanese Kokai Patent Application No. 2002-328732 discloses a circuit that generates a prescribed reference voltage, such as a bias voltage.

BACKGROUND

FIG. 7 shows the general configuration example of a circuit that supplies a reference voltage to an analog signal processing circuit.

The circuit shown in FIG. 7 has resistors R5, R6 and capacitor C2. Resistors R5, R6 are connected in series between power supply voltage Vcc and reference potential G. Capacitor C2 is connected between the middle connection point of the series circuit and reference potential G. The voltage generated at capacitor C2 is obtained by dividing power supply voltage Vcc by the series circuit of resistors R5, R6. It is supplied as reference voltage Vref to analog signal processing circuit 90.

In the circuit shown in FIG. 7, since power supply voltage Vcc supplied to analog signal processing circuit 90 is divided to generate reference voltage Vref, an abrupt change in power supply voltage Vcc when the power is turned on will directly affect reference voltage Vref. If reference voltage Vref changes abruptly, noise containing many high-frequency components will be present in the output of the analog signal processing circuit. The noise will cause popping noise in the output when the power is turned on, especially in an audio signal processing circuit.

In order to restrain the noise generated when the power is turned on, in the circuit shown in FIG. 7, capacitor C2 is connected between the output terminal of reference voltage Vref and reference potential G. Since resistors R5, R6 and capacitor C2 constitute a low-pass filter, even if power supply voltage Vcc rises abruptly when the power is turned on, reference voltage Vref will rise slowly with a certain time constant. As a result, the high-frequency components causing popcorn noise can be suppressed.

The circuit shown in FIG. 7 suppresses noise by using a low-pass filter made up of resistors and a capacitor; however, the time for reference voltage Vref to rise to a prescribed level after the power is turned on is determined by the element values of the resistors and the capacitor. Also, the rising waveform is determined by the circuit configuration. In other words, the rising waveform of reference voltage Vref cannot be set as desired as far as the circuit configuration is concerned. Consequently, it is difficult to properly adjust the tradeoff between restraining the output noise when the power is turned on in the analog signal processing circuit and shortening the rise time of reference voltage Vref. For example, if the output noise is well restrained, the time delay from the time when the power is turned on to the beginning of signal processing will be relatively long.

Also, since the rise time is determined by the time constant of the resistors and capacitor, for an audio signal processing circuit, the capacitance of the capacitor must be very large in order to suppress the noise in the audible frequency band. As a result, the size of the element will be increased.

SUMMARY

A general object of the present invention is to provide a voltage supply circuit, which can reduce the noise generated in the output of the voltage supply circuit when the power of the circuit is turned on or off and which can shorten the time required for starting or ending the operation of the circuit. Another object of the present invention is to provide a circuit device, which can reduce the output noise when the power is turned on or off and can shorten the time required for starting or ending the operation.

These and other objects and features are provided in accordance with one aspect of the present invention by a voltage supply circuit that provides a reference voltage to a circuit. The voltage supply circuit comprises a voltage generating circuit that generates the reference voltage corresponding to an input digital signal and a voltage setting circuit that outputs the digital signal, which continuously changes the reference voltage from a reference potential to a prescribed potential after the power supply is started, corresponding to a signal indicating the start of the supply of power to the circuit and/or corresponding to the digital signal, which continuously changes the reference voltage from the prescribed potential to the reference potential, before the power supply is stopped corresponding to a signal indicating the stopping of the supply of power to the circuit.

By using this voltage supply circuit, when the digital signal input from the voltage setting circuit corresponding to a signal indicating the start of the supply of power to the circuit, the reference voltage is changed continuously from the reference potential to the prescribed potential after the power supply is started. Also, when the digital signal is output from the voltage setting circuit corresponding to a signal indicating the stopping of supply of power to the circuit, the reference voltage is changed continuously from the prescribed potential to the reference potential.

Since the reference voltage changes continuously, compared with the case when the reference voltage varies intermittently under the influence of the intermittent variation in the power supply voltage, the high-frequency output noise of the circuit can be reduced. Also, since the continuous variation of the reference voltage is set corresponding to the digital signal output by the voltage setting circuit, the reference voltage can be set to a prescribed waveform corresponding to the digital signal processing of the voltage setting circuit. In this way, the output noise of the circuit can be reduced, and the variation time of the reference voltage can be shortened.

The voltage setting circuit can set the reference voltage variation time when the reference voltage is varied continuously corresponding to a signal indicating the start cause or stop cause of the power supply. In this way, since the time of continuous variation of the reference voltage is set corresponding to the start cause or stop cause of the power supply, the time from the starting of power supply until the beginning of the operation of the circuit or the time from stopping of power supply until the end of the operation of the circuit can be set corresponding to the start cause or stop cause.

The voltage generating circuit may have a digital/analog converter that converts the digital signal output from the voltage setting circuit into an analog signal corresponding to the value of the digital signal. The voltage generating circuit may have a converting circuit that converts the digital signal output from the voltage setting circuit into a pulse-shaped voltage signal corresponding to the value of the digital signal and a smoothing circuit that smoothes the pulse-shaped voltage signal and outputs it as the reference voltage. The pulse-shaped voltage signal can be, for example a pulse density modulated (PDM) signal or a pulse width modulated (PWM) signal.

When the configuration is adopted, the voltage output from the converting circuit includes a component with a relatively low frequency corresponding to the variation in the pulse density or pulse width and a component with a relatively high frequency realized by each pulse. Since the high-frequency component is removed by the smoothing circuit, the low-frequency component, that is, the component corresponding to the digital signal, is output as the reference voltage.

This circuit device has a signal processing circuit that processes input signal on the basis of a reference voltage, a voltage generating circuit that generates the reference voltage corresponding to the input digital signal, and a voltage setting circuit that outputs the digital signal, which continuously changes the reference voltage from a reference potential to a prescribed potential after the power supply is started, corresponding to a signal indicating the start of the supply of power to the signal processing circuit and/or corresponding to the digital signal, which continuously varies the reference voltage from the prescribed potential to the reference potential, before the stopping of the power supply corresponding to a signal indicating the stopping of the supply of power to the signal processing circuit.

It can also have a power supply control circuit that starts the supply of power to the signal processing circuit corresponding to a first signal indicating the start of the supply of power to the signal processing circuit or a second signal indicating that a load is connected to the signal output line of the signal processing circuit. In this case, the voltage setting circuit makes the variation time of the reference voltage when the reference voltage is varied continuously corresponding to the second signal shorter than the variation time corresponding to the first signal. Also, the power supply control circuit can stop the supply of power to the signal processing circuit after the reference voltage is varied to the reference potential corresponding to a signal indicating the stopping of the supply of power to the signal processing circuit.

REFERENCE NUMERALS AND SYMBOLS AS SHOWN IN THE DRAWINGS

In the figures, 10 represents a signal processing circuit, 20 represents a voltage generating circuit,

21, 61 represents a DAC, 22 represents a low-pass filter, 30 represents a voltage setting circuit, 40 represents a voltage supply circuit, 50 represents a system control circuit, 60 represents a lower supply switch, 70 represents an earphone jack, 81 represents a speaker, 82 represents a plug, R1, R2 represents a resistor, C1 represents a capacitor.

DETAILED DESCRIPTION

According to the present invention, first, when the power of the circuit of the voltage supply is turned on or off, the noise generated in the output of that circuit can be reduced, and the time required for starting or stopping the operation of that circuit can be shortened. Second, the output noise can be reduced when the power is turned on or off, and the time required for starting or stopping the operation can be shortened.

Figure 1:
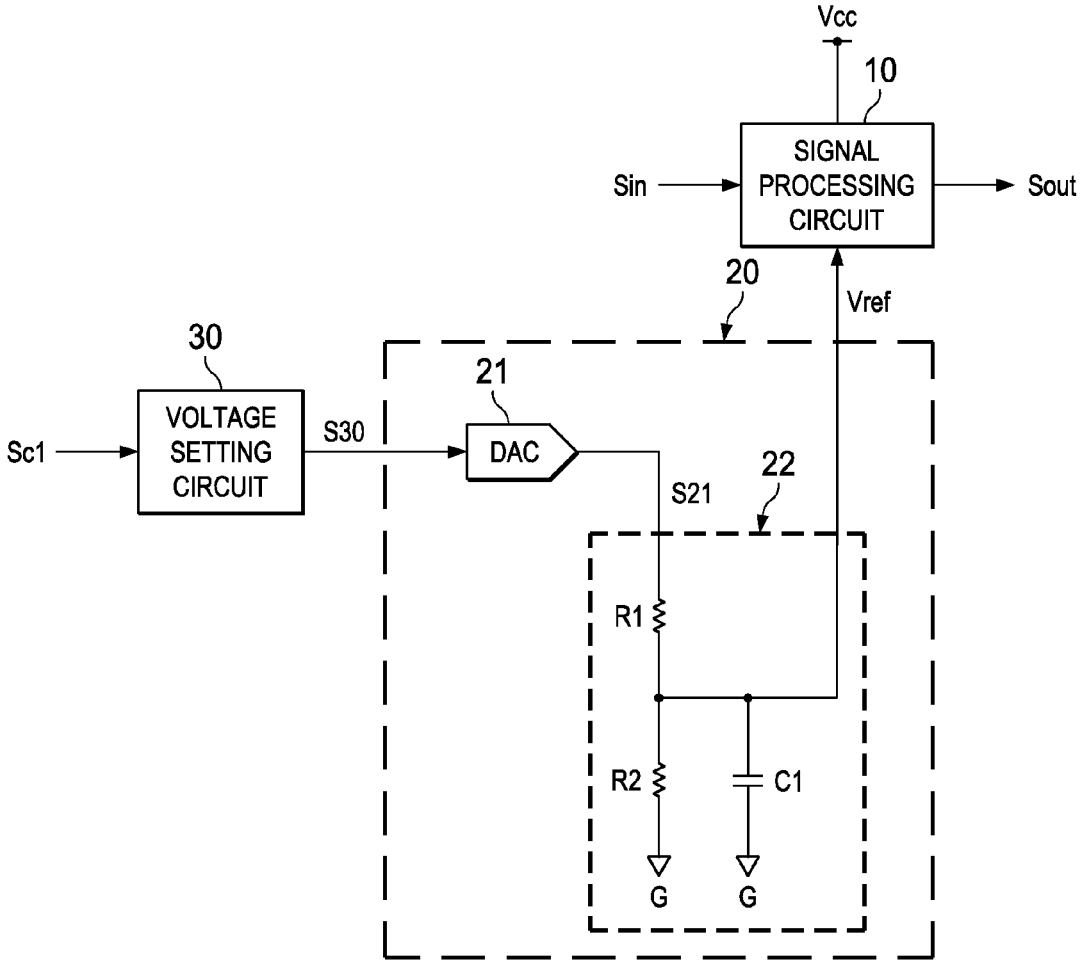
FIG. 1 shows an example of the configuration of the circuit device disclosed in the embodiment of the present invention.

FIG. 1 is a diagram illustrating an example of the configuration of the circuit device disclosed in the embodiment of the present invention.

The circuit device shown in FIG. 1 has a signal processing circuit 10, a voltage generating circuit 20, and a voltage setting circuit 30.

Signal processing circuit 10 processes input signal Sin using reference voltage Vref as a reference. For example, the amplitude of input signal Sin is amplified, or signal processing for noise removal, modulation, demodulation, frequency conversion, addition, or multiplication is carried out. The processing result is output as output signal Sout. Signal processing circuit 10 operates after receiving power supply voltage Vcc.

Figure 2:
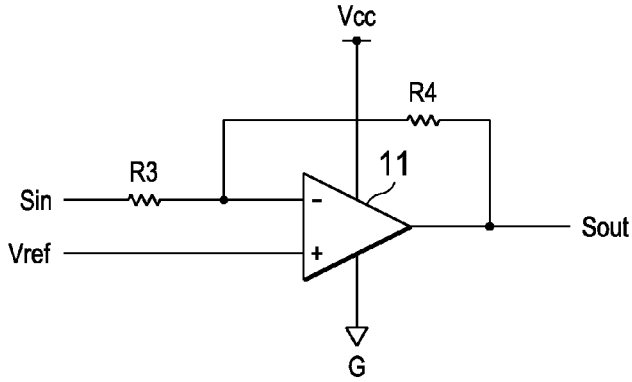
FIG. 2 shows an example of the configuration of signal processing circuit 10.

FIG. 2 shows an example of the configuration of signal processing circuit 10.

Signal processing circuit 10 shown in FIG. 2 has operational amplifier 11 and resistors R3, R4. Input signal Sin is input to the inverting input terminal of operational amplifier 11 via resistor R3, and the output signal of operational amplifier 11 is negatively fed back via resistor R4. Reference voltage Vref is input into the non-inverting input terminal of operational amplifier 11. Output signal S out is output from the output terminal of operational amplifier 11. Operational amplifier 11 operates after receiving power supply Vcc to amplify and output the voltage difference between the non-inverting and inverting input terminals.

If the gain of operational amplifier 11 is high enough, negative feedback control will be carried out such that the voltages at the inverting and non-inverting input terminals of operational amplifier 11 are approximately equal to each other. Therefore, the amplitude of output signal Sout will be amplified by the gain corresponding to the resistance ratio of resistors R3 and R4 with respect to the amplitude of input signal Sin. If the resistances of resistors R3, R4 are represented by "r3", "r4", respectively, the following equation becomes valid.

$$Sout-Vref=(r4/r3)\times(Vref-Sin) \quad (1)$$

Variation ΔS in output signal Sout caused by the small variation ΔV of reference voltage Vref is expressed as follows.

$$\Delta S=(1+(r4/r3))\times\Delta V \quad (2)$$

As can be seen from equation (2), the variation component of reference voltage Vref is amplified along with input signal Sin in signal processing circuit 10. Consequently, the abrupt change in reference voltage Vref when the power is turned on becomes noise in output signal Sout.

Voltage generating circuit 20 generates reference voltage Vref corresponding to the input digital signal S30. In the example shown in FIG. 1, digital/analog converter 21 (referred to as DAC 21 hereinafter) includes resistors R1, R2 and capacitor C1. DAC 21 is a circuit that converts digital signal S30 into an analog signal. It operates after receiving the same power supply voltage Vcc as signal processing circuit 10.

Resistors R1 and R2 are connected in series between the output terminal of DAC 21 and reference potential G. One terminal of resistor R1 is connected to the output terminal of DAC 21. The other terminal of resistor R1 is connected to resistor R2, which in turn is connected to reference potential G. Capacitor C1 is connected between the middle connection point of resistors R1 and R2 and reference potential G. The output signal of DAC 21 is divided by resistors R1 and R2 and is smoothed by capacitor C1. The voltage generated on capacitor C1 is supplied as reference voltage Vref to signal processing circuit 10.

Voltage setting circuit 30 outputs digital signal S30 such that reference voltage Vref is continuously raised from reference potential G to a prescribed potential after the power supply is started, corresponding to signal Sc1 indicating the start of the supply of power to signal processing circuit 10. Also, digital signal S30 is output such that reference voltage Vref is lowered continuously from a prescribed potential to reference potential G before the power supply is stopped corresponding to signal Sc1 indicating the stopping of the supply of power to signal processing circuit 10. Voltage setting circuit 30 is constituted, for example, with a digital circuit. The continuous variation of reference voltage Vref is set by sequentially updating the value of digital signal S30 according to the timing of clock signal, etc. Voltage setting circuit 30 operates after receiving the same power supply voltage Vcc as signal processing circuit 10.

Figure 3:
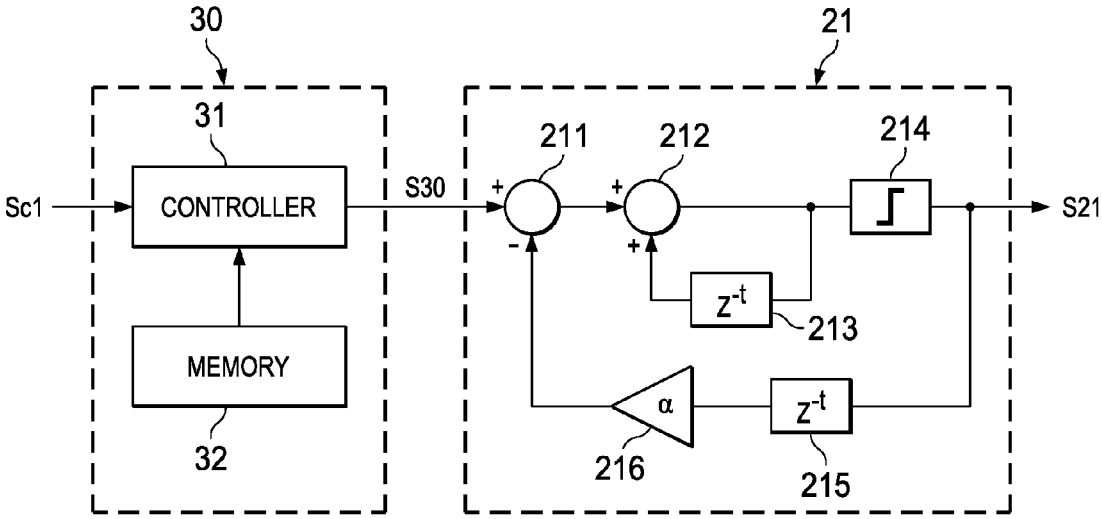
FIG. 3 shows an example of the configuration of DAC 21 and voltage setting circuit 30.

FIG. 3 shows an example of the configuration of DAC 21 and voltage setting circuit 30.

Voltage setting circuit 30 is a circuit that outputs the waveform data prestored in a memory. In the example shown in FIG. 3, the voltage setting circuit has control circuit 31 and memory 32.

DAC 21 is, for example, a 1-bit ΔΣ modulator. In the example shown in FIG. 3, it has adders 211, 212, delay circuits 213, 215, quantization circuit 214, and coefficient setting circuit 216.

Memory 32 stores the waveform data that sets the raising and lowering of reference voltage Vref. If the waveform data stored in memory 32 are fixed values, a simple ROM (read-only memory) can be used for memory 32. Control circuit 31 sequentially reads the waveform data for raising the reference voltage from memory 32 after the power supply is started, corresponding to signal Sc1 indicating the starting of the power supply and outputs it as digital signal S30 with a prescribed bit length. Also, the waveform data for lowering the reference voltage are read sequentially from memory 32 before the power supply is stopped corresponding to signal Sc1 indicating the stopping of power supply and are output as digital signal S30 with a prescribed bit length. If the raising and lowering waveforms are symmetric, the waveform data for raising and the waveform data for lowering can also be switched by reversing the order of reading the waveform data.

Adder 211 subtracts the output signal of coefficient signal 216 from digital signal S30 output from voltage setting circuit 30. Adder 212 adds the output signal of delay circuit 213 to the output signal of adder 211. Delay circuit 213 delays the output signal of adder 211 by one sample period and then outputs the output signal. Quantization circuit 214 quantizes the output signal of adder 212 and outputs a binary (high or low level) signal S21. For example, high-level or low-level signal S21 is output corresponding to whether the output signal of adder 214 exceeds a prescribed threshold value.

Delay circuit 215 delays the output signal S21 of quantization circuit 214 by one sample period and outputs that output signal. Coefficient circuit 216 multiplies the signal delayed by delay circuit 215 by a certain coefficient and outputs the product.

In DAC 21 shown in FIG. 3, adder 212 and delay circuit 213 comprise an integrator circuit. In the DAC 21, negative feedback control is performed such that the output signal S21 from quantization circuit 214 becomes equal to digital signal S30 as the input signal of quantization circuit 214. In this way, the signal S21 output from quantization circuit 214 becomes a pulse-shaped signal with the occurrence frequencies of high level and low level varying corresponding to the value of digital signal S30. In other words, DAC 21 outputs pulse-shaped signal S21 (pulse density modulation signal: PDM signal) with the pulse density modulated corresponding to the value of digital signal S30.

In the following, the operation of the circuit device shown in FIG. 1 having the configuration when the power is turned on and off will be explained.

Signal Sc1 indicates the start and stop timing of the power supply. It is output from a system control circuit not shown in the figure. Signal Sc1 sets control circuit 31 in the initial state during the period when the power is turned on to the time when power supply voltage Vcc is stabilized. Control circuit 31 outputs digital signal S30 that fixes reference voltage Vref at reference potential G during the initial period after the power is turned on. After a certain period of time has elapsed since the power is turned on, signal Sc1 indicates rise of reference voltage Vref to control circuit 31. Upon receiving the indication, control circuit 31 sequentially reads the waveform data for raising the reference voltage from memory 32 and outputs it as digital signal S30 to DAC 21. DAC 21 outputs pulse-shaped signal S21 with the pulse density modulated corresponding to the digital signal S30. Resistors R1, R2 and capacitor C1 connected to the output of DAC 21 constitute a voltage dividing circuit that divides the output signal S21 of DAC 21 and constitutes low-pass filter 22 (smoothing circuit) used for eliminating the high-frequency component included in output signal S21. The pulse-shaped signal S21 is smoothed by the low-pass filter 22. Reference voltage Vref rises continuously corresponding to setting of digital signal S30.

Figure 4:
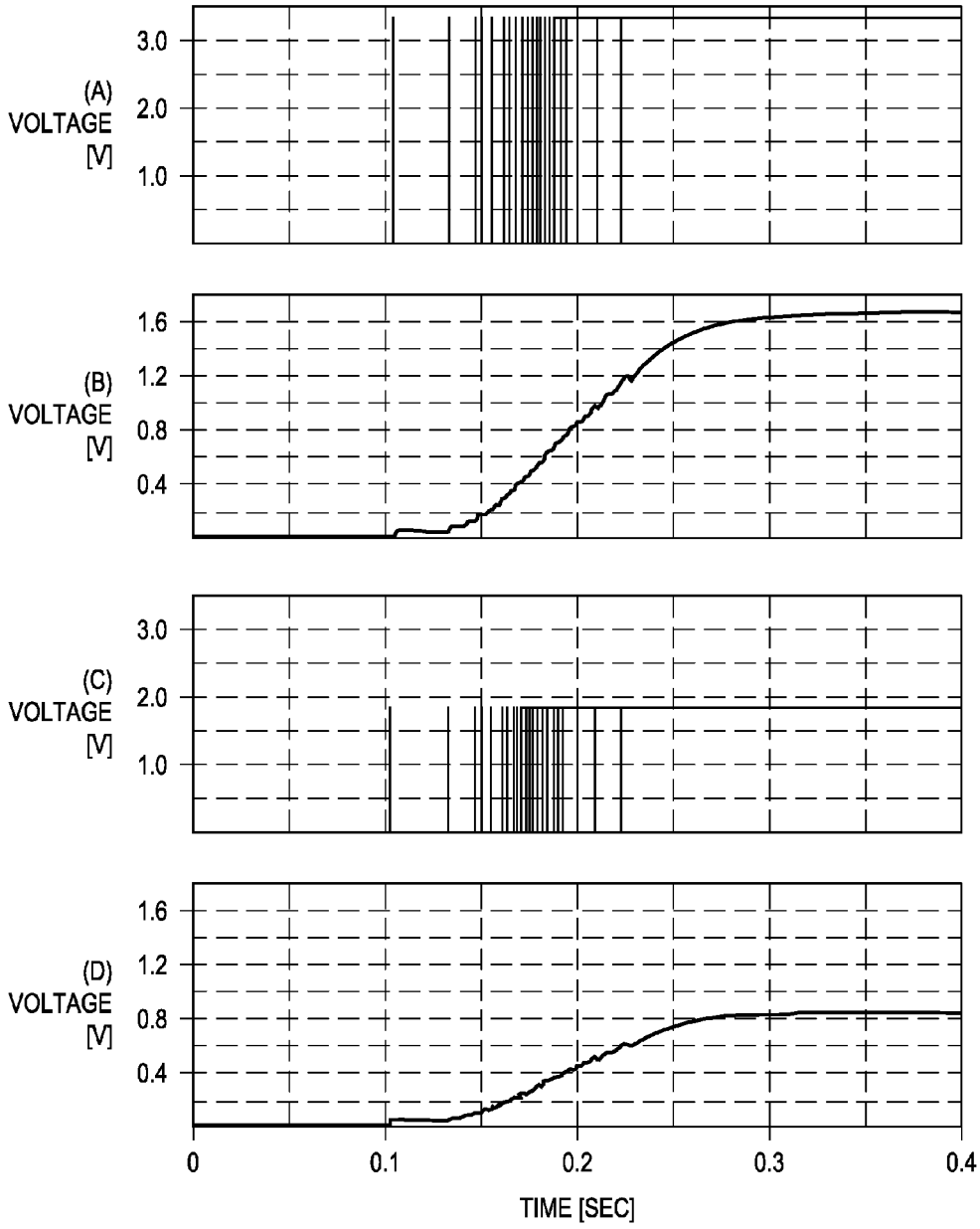
FIG. 4 shows an example of the output signal of DAC and the waveform for raising the reference voltage.

FIG. 4 shows output signal S21 of DAC 21 and the waveform for raising the reference voltage Vref. FIGS. 4(A), (C) show an example of the waveform of output signal S21 of DAC 21. FIGS. 4(B), (D) show an example of reference voltage Vref. The waveform of FIG. 4(B) is obtained by smoothing the waveform of FIG. 4(A). The waveform shown in FIG. 4(D) is obtained by smoothing the waveform of FIG. 4(C). FIGS. 4(A) and (B) and FIGS. 4(C) and (D) show the waveforms of two cases with different amplitudes of signal 21.

In the example shown in FIG. 4, digital signal S30 is generated on the basis of the waveform data with the phase of sinusoidal (sin) wave from "$-\pi/2$" to "$\pi/2$". Consequently, reference voltage Vref rises gradually as shown in FIGS. 4(B), (D). After that, the slope of the gradual rise increases. The slope becomes steepest when the level rises to about half of the final value. Then, the slope becomes more gradual again as the level approaches the target value.

On the other hand, when the power supply is stopped, first, signal Sc1 indicates a drop in the reference voltage Vref to control circuit 31. Upon receiving the indication, control circuit 31 sequentially reads the waveform data for lowering the reference voltage from memory 32 and outputs it as digital signal S30 to DAC 21. DAC 21 outputs a pulse-shaped signal S21 with the pulse density modulated corresponding to digital signal S30. Reference voltage Vref obtained by smoothing the signal drops continuously from a prescribed potential to reference potential G.

As explained above, according to this embodiment, since reference voltage Vref is varied continuously when power supply is started or stopped with respect to signal processing circuit 10, the high-frequency noise generated in the output of signal processing circuit 10 can be reduced compared with the case when reference voltage Vref varies intermittently under the influence of the intermittent variation of power supply voltage Vcc (for example, when power supply voltage Vcc is divided to generate reference voltage Vref).

Figure 7:
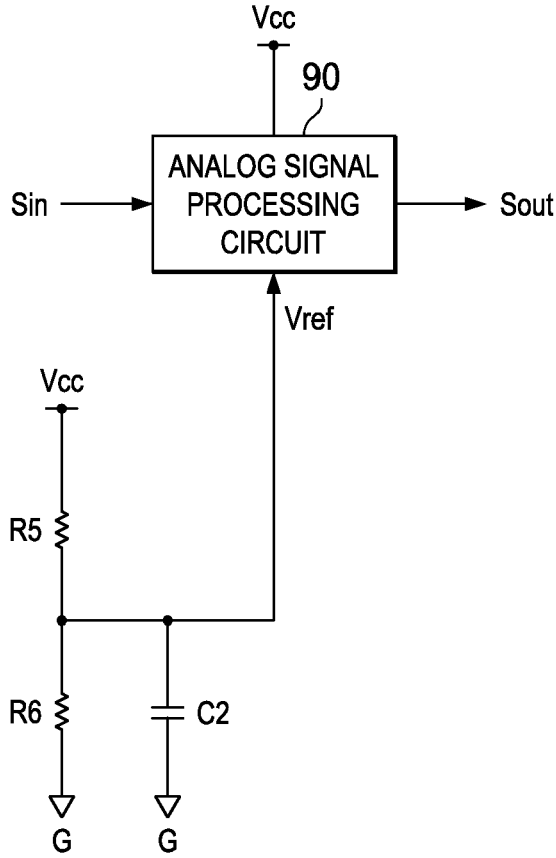
FIG. 7 shows a general configuration example of the substrate that supplies a reference voltage to an analog signal processing circuit.

Also, since the continuous variation in reference voltage Vref is set corresponding to digital signal S30 output by voltage setting circuit 30, it is possible to set the reference voltage to a prescribed waveform corresponding to digital signal processing in voltage setting circuit 30. In other words, when the set value of the waveform of reference voltage Vref is generated by digital signal processing in voltage setting circuit 30, the desired waveform can be easily generated without being limited by the values of the circuit elements or the circuit configuration, like the circuit shown in FIG. 7.

Consequently, if the peak-to-peak waveform data of a sinusoidal wave are prepared in memory 32 and are used to generate the waveform, a smooth waveform with few high-frequency components can be obtained, and a reference voltage Vref with shorter variation time than the waveform of an exponential function realized by low-pass filter can be generated. In this way, the output noise of signal processing circuit 10 can be reduced, and the variation time of reference voltage Vref can be shortened.

Also, according to this embodiment, digital signal S30 output from voltage setting circuit 30 is converted into pulse-shaped signal S21 having a pulse density corresponding to its signal value by DAC 21. The pulse-shaped signal S21 is smoothed in low-pass filter 22 (smoothing circuit) constituted by resistors R1, R2 and capacitor C1 to generate reference voltage Vref.

Consequently, if the time delay (sample period) of delay circuits 213, 215 is set to be much shorter than the variation time of waveform for raising or lowering the reference voltage formed by digital signal S30, even if the cutoff frequency of low-pass filter 22 is relatively high, the pulse-shaped high-frequency component of signal S21 can be well attenuated. In other words, the waveform of digital signal S30 can be faithfully reproduced in reference voltage Vref without significantly increasing the capacitance of capacitor C1. Consequently, capacitor C1 can be miniaturized, and the circuit area can be reduced.

Figure 5:
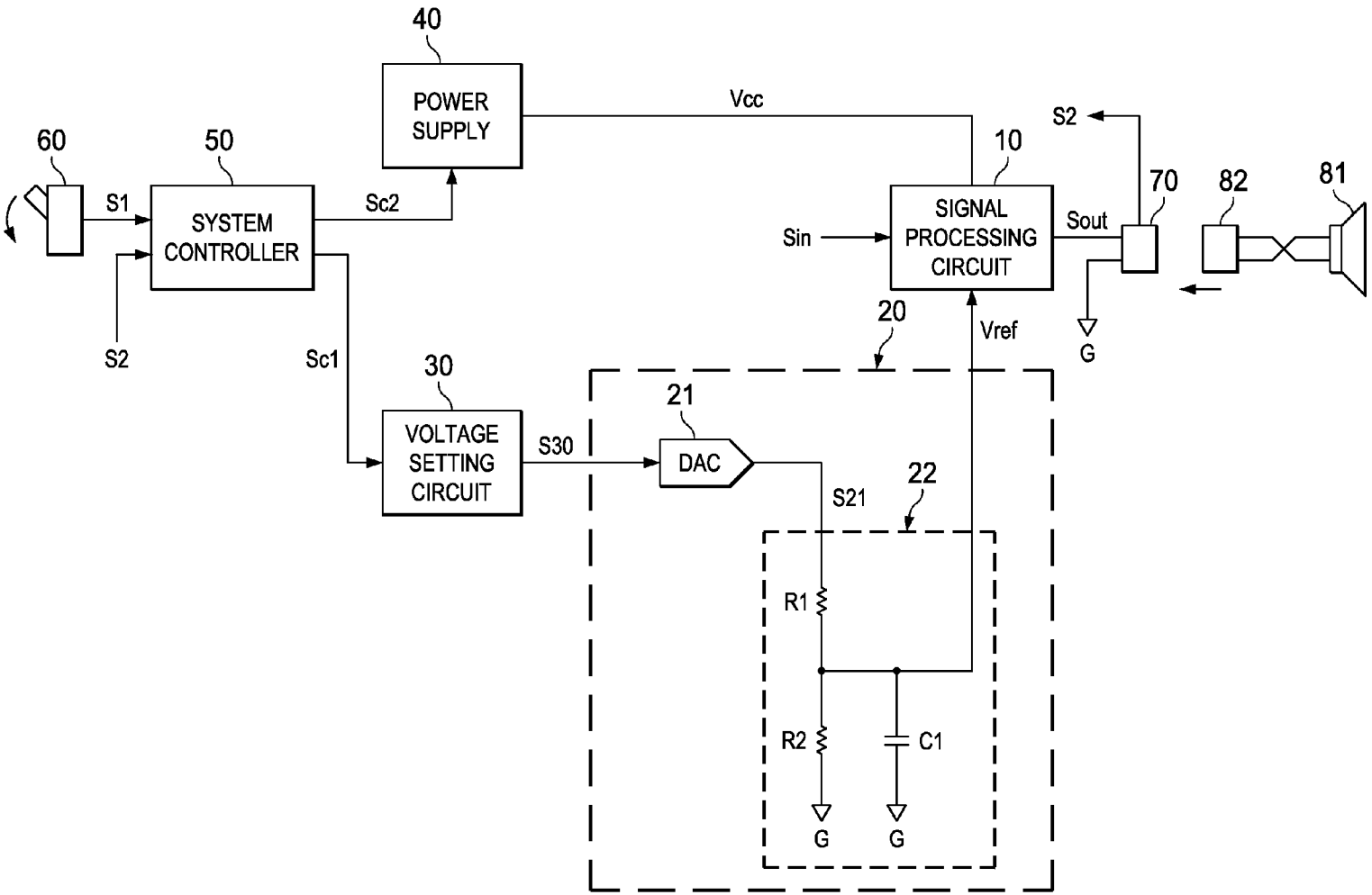
FIG. 5 is a diagram illustrating a modification example of the circuit device disclosed in this embodiment.

In the following, a modification example of the circuit device disclosed in this embodiment will be explained based on FIG. 5. Besides the configuration of the circuit device shown in FIG. 1, the circuit device shown in FIG. 5 also has power supply 40, system control circuit 50, power supply switch 60, earphone jack 70, plug 82, and speaker 81. Power supply 40 and system control circuit 50 are an embodiment of the power supply control circuit in the present invention.

Power supply 40 turns on or off the power supply voltage Vcc of signal processing circuit 10 corresponding to signal Sc2 of system control circuit 50. Power supply switch 60 is used to turn on or off the power of the entire circuit device. An on or off instruction is output as signal S1 to system control circuit 50.

Earphone jack 70 electrically connects plug 82 connected to speaker 81 and the signal output line of signal processing circuit 10. Also, signal S2 indicating whether plug 82 is plugged in (that is, whether speaker 81 is connected as a load to the signal output line of signal processing circuit 10) is output to system control circuit 50.

System control circuit 50 is a block that controls the operation of the entire circuit device. In the example shown in FIG. 5, it controls the turning on and off of power supply voltage Vcc in power supply 40 and the start of setting (rising or lowering) of reference voltage Vref by voltage setting circuit 30 corresponding to signal S1 output from power supply switch 60 and signal S2 output from earphone jack 70.

In the following, the operation of the circuit device shown in FIG. 5 will be explained.

System control circuit 50 first outputs signal Sc1 indicating a lowering of reference voltage Vref to voltage setting circuit 30 when signal S1 indicating the turning off of the power is input from power supply switch 60. Upon receiving the signal, voltage setting circuit 30 generates digital signal S30 by the operation explained above to lower reference voltage Vref continuously from a prescribed potential to reference potential G. When reference voltage Vref drops to reference potential G, system control circuit 50 then outputs signal Sc2 indicating the stopping of the supply of power supply voltage Vcc to power supply 40. In this way, the power of signal processing circuit 10 is turned off, and its operation is stopped.

On the other hand, when signal S1 indicating the turning on of power supply is input from supply switch 60, first, system control circuit 50 outputs signal Sc2 indicating the start of the supply of power supply voltage Vcc to signal processing circuit 10 to power supply 40. When power supply 40 starts to supply power supply voltage Vcc and signal processing circuit 10 starts to work, system control circuit 50 then outputs signal Sc1 indicating an increase in reference voltage Vref to voltage setting circuit 30. Upon receiving the signal, voltage setting circuit 30 generates digital signal S30 by the operation explained above to raise reference voltage Vref continuously from reference potential G to a prescribed potential.

As a result of the operation, the power of signal processing circuit 10 is turned on and off corresponding to the operation of power supply switch 60. In addition, the circuit device disclosed in this modification example turns on and off the power of signal processing circuit 10 corresponding to whether plug 82 is plugged into earphone jack 70. In other words, the power is off when plug 82 is not plugged in earphone jack 70, and the power is turned on when plug 82 is connected to earphone jack 70. In this way, the power consumption of signal processing circuit 10 can be reduced when load (speaker 81) is not connected to the output line.

More specifically, when signal S2 indicating the disconnection of plug 82 from earphone jack 70, system control circuit 50 first outputs signal Sc1 indicating a reduction in reference voltage Vref to voltage setting circuit 30. When reference voltage Vref drops to reference potential G, signal Sc2 indicating the stopping of the supply of the power supply voltage is output to power supply 40, and the power of signal processing circuit 10 is turned off.

Also, when signal S2 indicating the connection of plug 82 into earphone 70 is input, system control circuit 50 first outputs signal Sc1 indicating the start of the supply of power supply voltage Vcc to power supply 40, and the power of signal processing circuit 10 is turned on. When the power is turned on, signal Sc1 indicating an increase in reference voltage Vref is input to voltage setting circuit 30, and reference voltage Vref is raised from reference potential to a prescribed potential.

As described above, the circuit device shown in FIG. 5 controls the turning on and off of power supply to the signal processing circuit and the control (raising or lowering) of reference voltage Vref depending on the on and off operation of power switch 60 and connection or disconnection of plug 70 into earphone jack 70.

When the reason for the turning on and off of the power supply is different, the content required for the operation, which focuses on speed or noise, will vary. For example, it is desired to reduce the popping noise generated from speaker 81 as much as possible rather than to output sound immediately from speaker 81 when the device is started by turning on power switch 60. On the other hand, when plug 70 is plugged into earphone jack 70, it is desired to output sound from speaker 81 immediately even if some noise is generated.

The circuit device disclosed in this modification example sets the reference voltage variation time when reference voltage Vref is varied continuously corresponding to signals (S1, S2) indicating start cause or stop cause of the power supply. For example, the reference voltage variation time when reference voltage Vref is varied corresponding to signal S2 is shorter than the reference voltage variation time when reference voltage Vref is varied continuously corresponding to signal 51. In other words, when plug 70 is plugged in or unplugged from earphone jack 70, the times required to raise or lower reference voltage Vref are shorter than those in the case of the turning on and off of power switch 60.

If the control (variation time for raising and lowering) reference voltage Vref is set corresponding to the reason for turning the power on and off as described above, a suitable compromise between increasing the operating speed and reducing the popping noise can be found.

Figure 6:
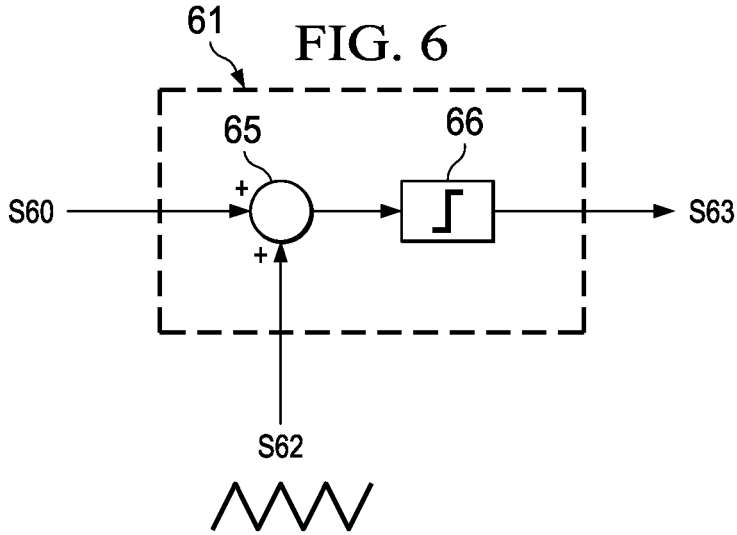
FIG. 6 shows a modification example of DAC.

An embodiment and a modification example of the present invention have been explained above. The present invention is not limited to these. It also includes other variation examples. For example, in FIG. 3, a method that reads out the waveform data stored in memory 32 was explained as a configuration example of voltage setting circuit 30. However, the present invention is not limited in this way. If the raising and lowering waveform is expressed as a simpler function, it is also possible to generate digital signal S30 using a digital circuit that carries out the prescribed function. Also, a $\Delta\Sigma$ modulator was used as DAC 21. However, the present invention is not limited in this way. Other types of digital/analog converters can also be used. For example, it is also possible to use DAC 61 using the pulse width modulator (PWM modulator) shown in FIG. 6 instead of DAC 21 using the pulse density modulator (PDM modulator) shown in FIGS. 1 and 3. In DAC 61 shown in FIG. 6, adder 65 adds input digital signal S60 and digital signal S62 having a triangle wave and outputs the result to quantization circuit 66. Quantization circuit 61 outputs a pulse-shaped signal S63 (PWM signal) with pulse width modulation (PWM). Quantization circuit 61 can have the same configuration as the quantization circuit shown in FIG. 3. In FIG. 2, an amplifier circuit was used as signal processing circuit 10. However, the present invention is not limited in this way. The present invention can be used to supply reference voltage to other types of analog signal processing circuits.

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Accordingly, it is appropriate that the appended claims be construed broadly and in a manner consistent with the scope of the invention.

The invention claimed is:

1. An apparatus comprising: a power supply;

an amplifier that is coupled to the power supply and that receives an input signal and generates an output signal;

a controller that generates a first control signal and a second control signal, wherein the controller provides the first control signal to the power supply so as to activate and deactivate the power supply;

a voltage setting circuit that is coupled to the controller so to receive the second control signal, wherein the voltage setting circuit generates a digital signal based at least in part on the second control signal that corresponds to a magnitude of a reference voltage, and wherein the controller varies the second control signal at power-up such that the magnitude of the reference voltage is increased from a reference potential to a predetermined potential at a predetermined rate, and wherein the controller varies the second control signal at power-down such that the magnitude of the reference voltage is decreased from the predetermined potential to the reference potential at the predetermined rate; and a voltage generator having:

a digital-to-analog-converter (DAC) that is coupled to voltage setting circuit so as to receive the digital signal; and a filter that is coupled between the DAC and the amplifier so as to provide the reference voltage to the amplifier;

wherein the controller further comprises a first controller, and wherein the voltage setting circuit further comprises:

a second controller that is coupled to the first controller and the DAC; and a memory that is coupled to the controller;

wherein the DAC further comprises: a subtracter that is coupled to the second controller; an adder that is coupled to the subtracter; a first delay circuit that is coupled to the adder; a quantizer that is coupled to the adder and the filter; a second delay circuit that is coupled to the quantizer; and a coefficient setting circuit that is coupled to the second delay circuit and the subtracter.

2. The apparatus of claim 1, wherein the filter further comprises:

a voltage divider that is coupled to the quantizer and the amplifier, wherein the voltage divider includes a plurality of resistors coupled in series with one another;

and a capacitor that is coupled in parallel to at least one of the plurality of resistors.

* * * * *